United States Patent [19]

Kitamura et al.

[11] 4,417,723

[45] Nov. 29, 1983

[54] TUYERE FOR BLOWING GASES INTO MOLTEN METAL BATH CONTAINER

[75] Inventors: Minoru Kitamura, Nishinomiya; Shinji Koyama; Shuzo Ito, both of Kobe; Masahiko Ohgami, Kakogawa; Hideo Matsui, Hyogo; Isamu Hirose, Kakogawa; Hideaki Fujimoto, Akashi; Tsuyoshi Yasui, Kobe, all of Japan

[73] Assignee: Kabushiki Kaisha Kobe Seiko Sho, Kobe, Japan

[21] Appl. No.: 336,685

[22] Filed: Jan. 4, 1982

[30] Foreign Application Priority Data

Oct. 22, 1981 [JP] Japan ..... 56-169465

[51] Int. Cl.[3] ..... C21B 7/16

[52] U.S. Cl. ..... 266/265; 266/266

[58] Field of Search ..... 266/265-266

[56] References Cited

U.S. PATENT DOCUMENTS

| | | | |
|---|---|---|---|
| 3,330,645 | 7/1967 | De Moustier et al. . | |
| 3,343,829 | 9/1967 | Coates . | |
| 3,397,878 | 8/1968 | Holmes et al. . | |
| 3,490,775 | 12/1967 | Henshaw . | |
| 3,615,086 | 6/1969 | Jepson et al. . | |
| 3,703,279 | 11/1972 | Saccomano et al. . | |
| 3,724,830 | 4/1973 | Saccomano et al. . | |
| 3,744,781 | 7/1973 | Gabler . | |
| 3,844,768 | 10/1974 | Leroy | 75/60 |
| 3,971,548 | 7/1976 | Folgero | 266/265 |
| 4,022,447 | 5/1977 | Griffiths . | |
| 4,249,719 | 2/1981 | Knuppel et al. . | |
| 4,266,970 | 5/1981 | Iwaoka | 75/60 |
| 4,268,017 | 5/1981 | Cole | 266/265 |
| 4,293,123 | 10/1981 | Sauert . | |
| 4,311,518 | 1/1982 | Savard | 75/60 |

*Primary Examiner*—P. D. Rosenberg

*Attorney, Agent, or Firm*—Oblon, Fisher, Spivak, McClelland & Maier

[57] ABSTRACT

A blowing tuyere to be embedded in a bottom of side wall of a molten metal bath container for blowing a gas thereinto, the tuyere including a cylindrical core body fixedly located at the center of the tuyere and an outer tube fixed concentrically around the core body with a gap of a predetermined width to form an annular blowing passage therebetween.

8 Claims, 15 Drawing Figures

PRIOR ART

PRIOR ART

INNER TUBE $O_2 = 500\ Nm^3/Hr$

OUTER TUBE $\begin{cases} Pr = 70\ Nm^3/Hr \\ Ar = 0\ Nm^3/Hr \end{cases}$

INNER TUBE $O_2 = 200^{Nm^3}/Hr$

OUTER TUBE $\begin{cases} Pr = 28^{Nm^3}/Hr \\ Ar = 40^{Nm^3}/Hr \end{cases}$

INNER TUBE $O_2 = 500^{Nm^3}/Hr$

OUTER TUBE $Pr = 70^{Nm^3}/Hr$

INNER TUBE $O_2 = 200 Nm^3/Hr$

OUTER TUBE $\begin{cases} Pr = 28\ Nm^3/Hr \\ Ar = 40\ Nm^3/Hr \end{cases}$

TUYERE FOR BLOWING GASES INTO MOLTEN METAL BATH CONTAINER

BACKGROUND OF THE INVENTION

1. Field of the Art

This invention relates to a gas blowing tuyere to be used in bottom or side walls of various metal refining furnaces or molten metal containers such as ladles and the like.

2. Description of the Prior Art

There are many types of containers for holding molten metal for refining, lagging, storing, transporting or for other purposes. For example, in addition to LD converters, there are known a diversity of converters, including LF furnace, VAD furnace, AOD furnace, ASEA-SKF furnace and RH and DH vacuum melters. Among known molten metal containers other than those refining furnaces are ladles, metal mixers, mixer cars and the like. Most of such molten metal containers more or less require stirring the content constantly or intermittently. Of the various mechanical and gas stirring systems which are employed in the art, the present inventors conducted an extensive study on the gas stirring particularly in refining processes in top and bottom blown LD-converters using oxygen for top blowing and an inert gas or oxygen wrapped in a cooling gas for bottom blowing, and as a result arrived at some conclusions. More specifically, a study on the tuyere construction suitable for bottom blowing an inert gas or oxygen in the LD-converter has succeeded in determining a tuyere construction which permits to set or vary the blowing gas flow rate over a wide range and to suppress the erosion of the tuyere itself and the surrounding refractory material to a significant degree. Further, experiments on the tuyere construction according to the present invention have revealed that it is widely useful for various molten metal containers other than LD-converters.

The converters which are designed to blow pure oxygen into molten metal are generally classified as a top blowing type and a bottom blowing type, of which the top blowing type has been more popular in the art although both have long histories of use. However, the bottom blowing type converter are increasingly accepted these days to utilize the stirring effect peculiar to the climbing streams of the bottom blown gas. Namely, it has been revealed that metallurgical reactions are improved to a significant degree as a result of the positive stirring actions of the climbing gas streams on the molten steel and slag, as compared with a pure oxygen top blowing type converter. Therefore, there is even a trend of entirely replacing the top blowing type converters by the bottom blowing type. The present inventors have conducted a study of the top and bottom blowing converters in an attempt to develop a new refining process which incorporates top and bottom blown gases parallelly in such a manner as to secure the advantages of the bottom blowing while retaining the merits of the top blowing, for instance, versatility in refining.

In advancing research on the top and bottom blowing converters, either one of the following two approaches which are conceivable in this connection was adopted in consideration of the conditions of an iron works.

(1) A system in which several to several tens percent of the total quantity of feed oxygen is blown in through the bottom; or (2) A system in which the total quantity of feed oxygen is used for top blowing while blowing in an inert gas through the bottom at a relatively low flow rate (e.g., at a rate of 0.01–0.2 $Nm^3$/min per ton of a charge).

The enhancement of the stirring action by the bottom blowing brought about the following effects.

(A) The composition and temperature of the molten bath were maintained uniform in the entire areas of the furnace, improving the success rate of attaining a target composition at turn down.

(B) The efficiency of oxygen which is consumed in decarburization reactions was enhanced, lowering the prime consumption of the refining oxygen.

(C) The percentages of the T.Fe component in the slag at turn down was reduced, improving the yield of steel.

(D) The O-content of steel was reduced and the Mn-content was increased at turn down. Therefore, it became possible to reduce the amounts of Al and Fe-Mn which were added for adjusting the composition.

(E) The dephosphorization capacity of the slag was improved, permitting a reduction in the prime consumption of a subsidiary material like calcined lime.

Although the above-mentioned effect of improving metallurgical reactions was largely influenced by the flow rate of the bottom blown gas, it was only produced in a conspicuous degree up to a flow rate of approximately 0.05 $Nm^3$/min per ton of molten steel in the case of an inert gas bottom-blowing system, with no remarkable improvement in that effect occurring even if the flow rate of the bottom blowing gas were increased further. Rather, in the case of a high carbon steel with a turn down C-content greater than 0.60%, the T.Fe content of the slag was reduced considerably at turn down, giving rise to a problem concerning degraded dephosphorization capacity. Therefore, studies were carried out in search of the bottom blowing conditions free of the adverse effects on the dephosphorization capacity, repeating extensive experiments. As a result, it was found that the advantages of the bottom blowing can be acquired without causing the above-mentioned problems by restricting the flow rate of the bottom blowing gas to about 0.1 $Nm^3$/min versus one ton of molten steel when refining a high carbon steel.

With regard to the tuyere construction for the bottom blowing, there are known in the art (I) a tuyere consisting of a single tube and (II) a tuyere which includes concentric double tubes. The former is used for exclusively blowing in an inert gas, while the latter is used for blowing in oxygen through the inner tube and a protecting or cooling gas through the outer tube. These tuyeres, however, have the following drawbacks when used for blowing an inert gas. Referring to FIG. 1 which illustrates a mono-tube tuyere 1 as embedded in a refractory bottom wall 2 of a furnace, the molten steel 5 in the vicinity of the bottom wall 2 is partly solidified by the primary cooling action of the blown-in gas, forming a mushroom (a mass of base metal) as indicated by 3. The blown-in gas is injected into the molten steel 5 through narrow gas passages 4 which are formed in the mushroom 3, and climbs up through the molten steel 5 in the form of bubbles 6. In some cases, however, the gas passages 4 are not sufficiently formed due to an increased resistance of the mushroom 3 and the blowing is blocked with relatively high frequency, failing to blow in the gas in a stable condition. In order to avoid this problem, the back pressure of the tuyere has to be raised to a level higher than 10 kg/cm$^2$G in the case of a mono-tube tuyere, although it depends on the static pressure of the molten steel. On the other hand, if the flow rate of the blowing gas is to be maintained at a value lower than 0.1 Nm$^3$/min versus one ton of molten steel as mentioned hereinbefore, it becomes necessary to make the tuyere hole diameter smaller. In order to satisfy these requirements in a process which involves control of the blowing gas flow rate over a wide range, there have been imposed further restrictions, i.e., a pressure increase to a range over 10 kg/cm$^2$G for stable blowing operation and the use of a blowing facilities which are calibrated to an extremely high pressure.

In an attempt to solve these problems, extensive experiments have been conducted using a tuyere of concentric double tubes (FIG. 2) instead of the above-mentioned mono-tube tuyere, and it was found that an aimed gas flow rate can be secured in a relatively stable manner by maintaining the back pressure of the outer tube at a predetermined high level, without extremely reducing the opening diameter of the inner tube.

The double-tube tuyere has been effective particularly for simultaneously blowing in a gas and powder or the like, in addition to injection of a large quantity of oxygen or the like. However, even the concentric double-tube tuyere has a problem in that the gas flows from the inner tube have a large influence and in some case the blowing operation is thereby rendered unstable. Therefore, it is unsuitable particularly for blowing in a gas at a relatively small flow rate or for controlling the gas flow rate over a wide range, as manifested, for example, by the results of experiments shown in FIGS. 3 and 4.

More specifically, the graphs of FIGS. 3 and 4 show variations in the gas flow rates of a concentric double-tube tuyere which is anchored in a bottom wall of a converter to blow in oxygen through the inner tube and a cooling CnHm gas through the outer tube, detecting the blowing gas pressure in pipings in the vicinity of the tuyere. Although no large variations in flow rates are observed in FIG. 3, the blowing becomes unstable with extremely large variations in the inner and outer tube pressures Ip and Op in the case of FIG. 4 where the flow rate of oxygen through the inner tube is about 1/2.5. It will be understood therefrom that the use of a concentric double-tube tuyere does not give sufficient solutions to the above-mentioned problems. Besides, the convention tuyeres have a detrimental drawback in that the refractory wall around the tuyere is worn out considerably by the actions of the gas jets which are injected into the molten steel, particularly by the bottom beating actions (back attacks) of the downward streams which are formed immediately after injection. In view of these circumstances, it has been concluded that the conventional tuyeres are defective in construction for blowing in an inert gas or oxygen, and a tuyere of the afore-mentioned novel construction has been provided as a result of extensive studies and experiments.

With regard to the literatures disclosing converter tuyeres, Japanese Laid-Open Utility Model Specification No. 55-142554, and 54-110608, Japanese Laid-Open Patent Specification No. 50-87908 and Japanese Patent Publication Specification Nos. 43-29843 and 49-21002 are cited here as references of interest.

SUMMARY OF THE INVENTION

It is therefore an object of the present invention to solve the above-mentioned problems of the conventional blowing tuyeres. A more particular object of the present invention is to provide an improved blowing tuyere which is capable of uniform and stable gas blowing operations continuously and which is adapted to suppress to a minimum the erosion of surrounding refractory walls by back attacks of injected gases which would otherwise shorten the service life of the converter.

BRIEF DESCRIPTION OF THE DRAWINGS

Various other objects features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 5:
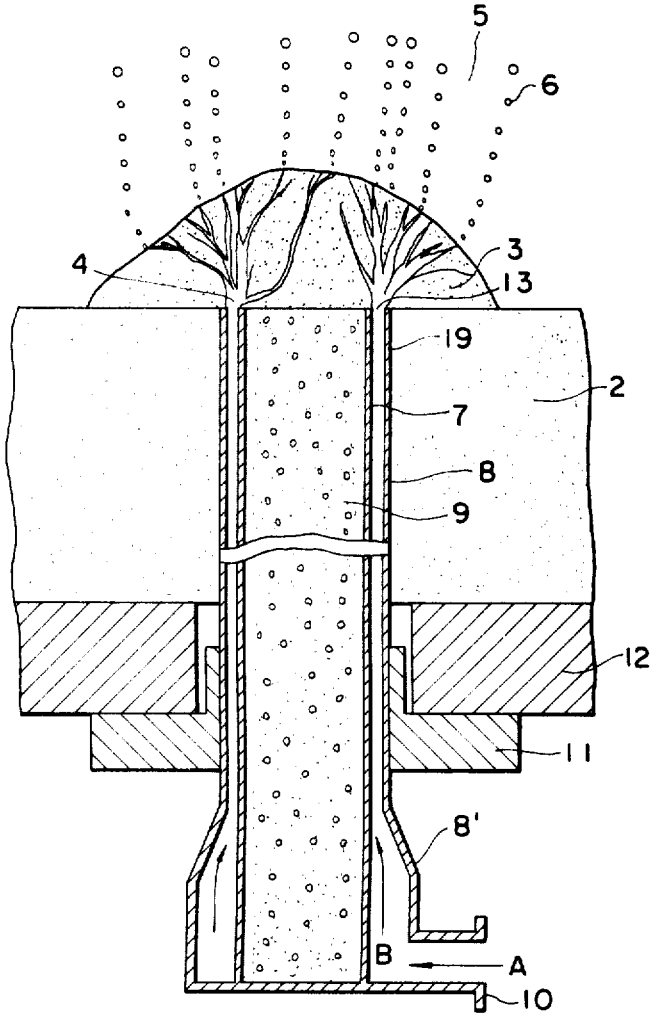
FIG. 5 is a sectional view of a single-annular blowing tuyere according to the present invention.

Referring to FIG. 5 showing in section a representative single type annular tuyere for blowing an inert gas, the tuyere includes a cylindrical core body 19 with a refractory material 9 filled in an inner tube 7, and an outer tube 8 which is disposed concentrically on the outer side of the inner tube 7 with an apppropriate gap or space formed therebetween. The outer tube 8 has a lower bulged portion 8' with a blowing gas inlet 10 at the lower end thereof an a flange 11 which projects integrally from the outer tube body at a position slightly above the bulged portion 8' to thereby secure the tuyere to a shell 12. Thus, an inert gas which enters the outer tube 8 in the direction of arrow A through the gas inlet 10 climbs up the bulged portion 8' as indicated by arrow B and leaves the tuyere through an annular spout 13 formed between the inner and outer tubes 7 and 8. In this instance, a mushroom 3 is likewise formed over the tuyere so that the inert gas is released into molten steel 5 through gas passages 4 and rises in the form of small bubbles 6.

In a tuyere of such construction, if the refractory core material 9 is removed and the tuyere is of a simple double-tube construction (FIG. 2), the bubbles which are released from the inner tube 7 of a large diameter are naturally increased in size to impose a greater mechanical influence on the occasion of back attacks as mentioned hereinbefore, accelerating the erosion of the refractory walls of the furnace. On the contrary, if the inner cavity of the inner tube 7 is filled with a refractory material 9 to blow in a gas solely through the annular spout 13 which is defined between the inner and outer tubes 7 and 8, the size of bubbles are reduced in general so that they do not have so strong an influence as would accelerate the erosion of the refractory walls. In order to weaken the back attacks, it is desired to make the width of the gap between the inner and outer tubes 7 and 8 as small as possible, more particularly, to make the width of the gap smaller than 3 mm, preferably smaller than 2 mm.

Figure 6:
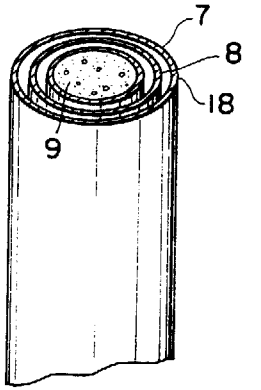
FIG. 6 is a perspective view of another embodiment of the present invention, which is in the form of a double-annular blowing tuyere.

In FIG. 6 which illustrates another embodiment of the present invention in a perspective view, an outermost or second outer tube 18 is disposed concentrically around the first outer tube 8 with a small gap or space formed therebetween. Thus, there is formed a dual annular tuyere, which will be hereinafter referred to as a dual type annular tuyere. In this instance, it is possible to blow two different gases through the respective annular tuyere holes in a refining process, for example, to blow in pure oxygen through the inner tuyere hole and an inert gas or a cooling gas through the outer tuyere hole.

In FIG. 6, the dual type annular tuyere is shown as having a central core body with a refractory material filled in an inner tube, but there may be employed a tuyere construction which instead has a round solid rod of a refractory material or ceramic or other filler material at the center thereof.

Figure 2:
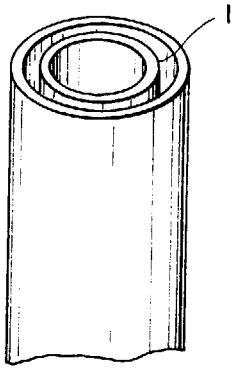
FIG. 2 is a perspective view of a conventional concentric double-tube tuyere.
Figure 3:
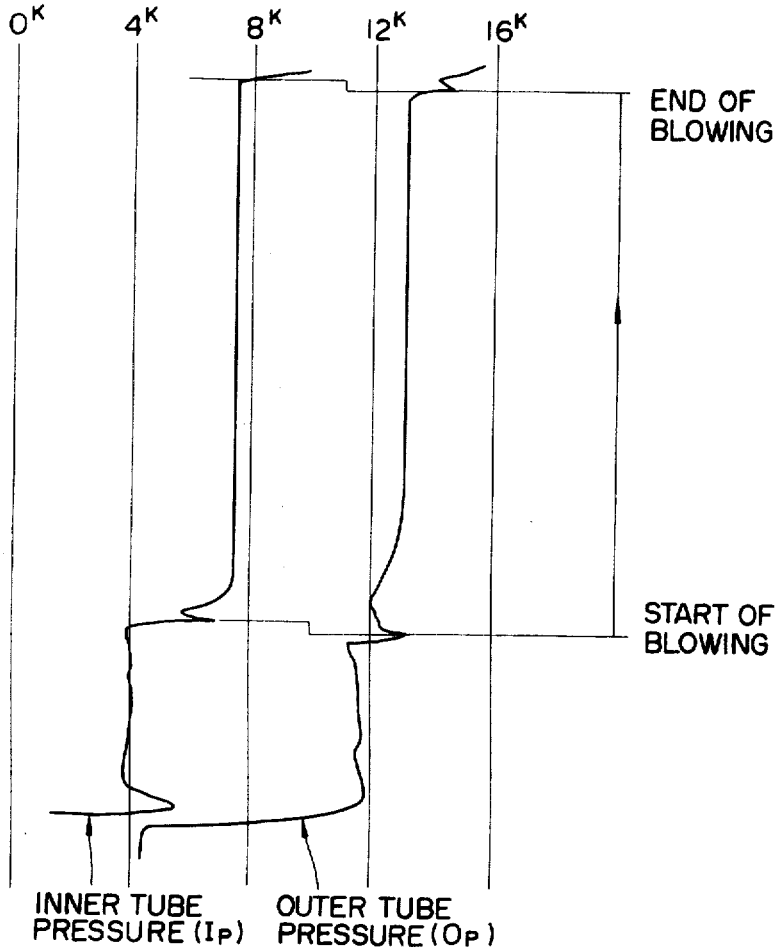
FIGURE 3 PRIOR ART
FIG. 3 is a graph plotting variations in internal pressures of tuyere tubes in a high flow rate blowing operation by the concentric double-tube tuyere.
Figure 4:
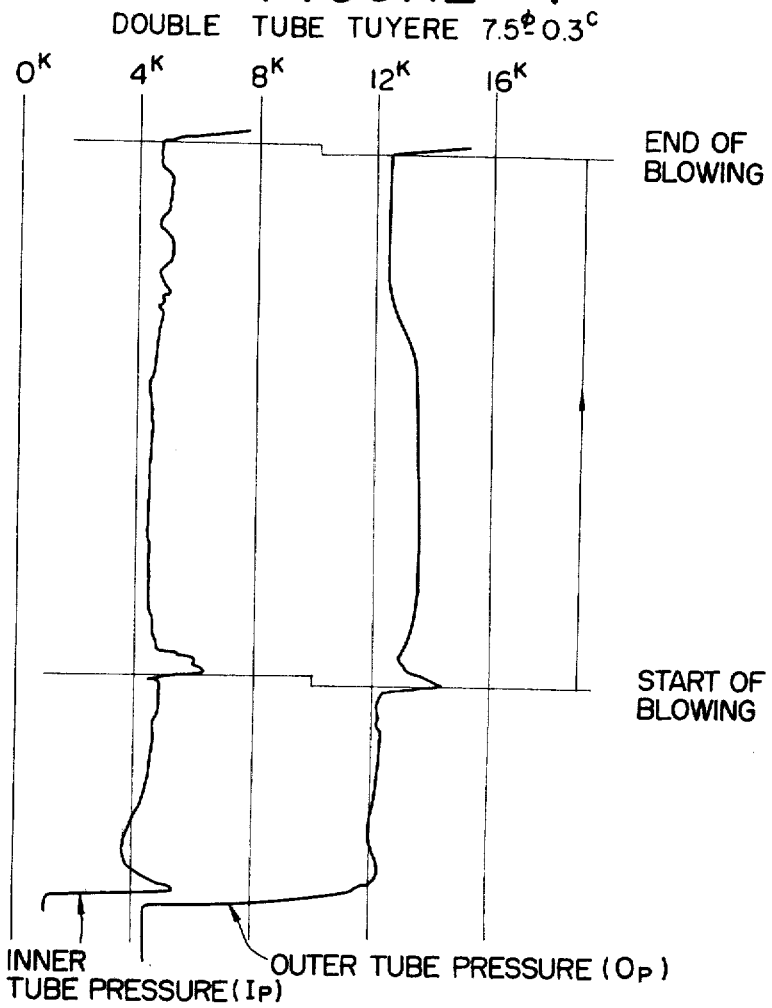
FIGURE 4 PRIOR ART
FIG. 4 is a graph plotting variations in internal pressures of tuyere tubes in a low flow rate blowing operation by the conventional concentric double-tube tuyere.
Figure 7:
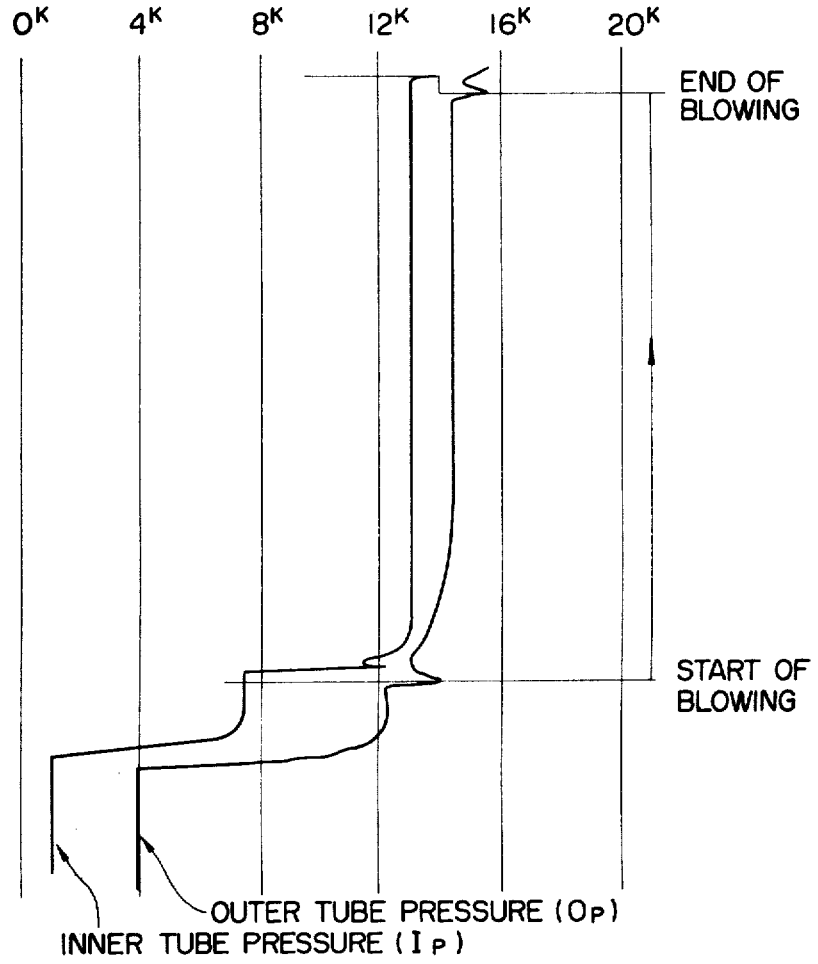
FIG. 7 is a graph plotting variations in internal pressures in a high flow rate blowing operation by the double-annulus or dual type annular tuyere of the invention.
Figure 8:
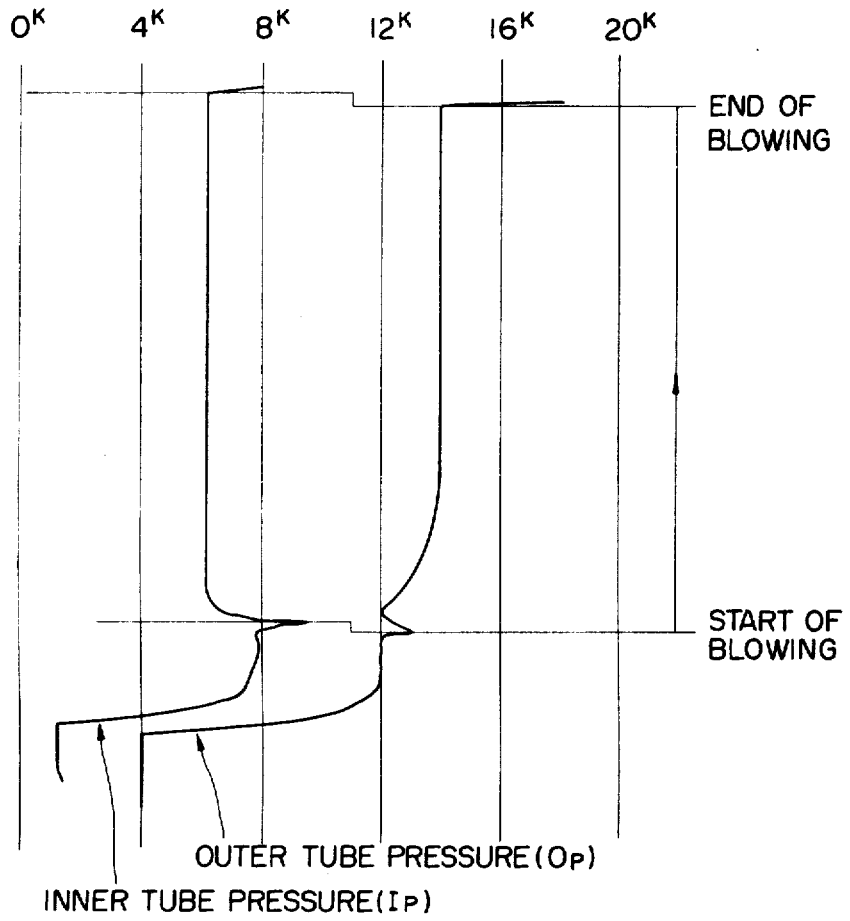
FIG. 8 is a graph plotting variations in internal pressures in a low flow rate blowing operation by the dual type annular tuyere of the invention.

Another important effect of the blowing tuyere according to the present invention is that the flow rate of the blowing gases can be controlled over a range which is incomparably broader than the ranges of the conventional tuyeres. For instance, FIGS. 7 and 8 show the results of experiments on the dual type annular tuyere (FIG. 6) in a manner similar to FIGS. 3 and 4. More specifically, as shown in FIGS. 7 and 8, the blow-in gas pressure remains stable even when the flow rate of oxygen gas is reduced to about 1/2.5 in contrast to the performance of the conventional concentric double-tube tuyere (FIG. 2). The stability of the inner pressure Ip in the low flow rate blowing by the dual type annular tuyere (FIG. 8) is regarded as indicating the stability of the blowing gas pressure in a low flow rate blowing operation by the single type annular tuyere (FIG. 5). Although the reasons for these phenomena are not clear in certain aspects, stable blowing operation is possible in a relatively low flow rate range without lowering the tuyere back pressure as the gas velocity at the spout end of the tuyere is higher. Further, the minimization in size of bubbles of the gases spouted from the tuyere is considered to contribute to the suppression of back attacks which take place in the vicinity of the tip end of the tuyere due to production of large bubbles when a tuyere of the conventional concentric double-tube construction is used.

In any event, a situation where the single type annular tuyere is employed for bottom-blowing an inert gas, for example, in a refining process of a high carbon steel, the gas is blown in at a flow rate of about 0.05 $Nm^3$/min.ton. On the other hand, for refining a low carbon steel, it is possible to blow in the gas at a flow rate as high as 0.1–0.15 $Nm^3$/min,ton to make use the improving effect of the process to a maximum degree.

The range of such flow rate control varies depending upon the tuyere design. For example, stable blowing operation is possible in the range of 0.02–0.057 $Nm^3$/min.ton in a case employing a pair of single type annular tuyeres each having an inner core tube of 15.5 mm in outside diameter and a gap width of 1.8 mm between the inner and outer tubes, and controlling the blowing gas pressure as represented by the tuyere back pressure in the range of about 5.5–18.0 $kg/cm^2$. In a case using a tuyere with an inner tube of 30 mm in outside diameter and a gap width of 1.8 mm, stable operation is possible in the range of about 0.02–0.093 $Nm^3$/min.ton under the same blowing conditions. Thus, the blowing tuyere according to the present invention permits easy control of the flow rate in a broad range of 3 to 5 as a ratio of the maximum to minimum flow rate, an amazing attainment as compared with the conventional tuyeres in which the ratio is 1.5 to 2.0 at most.

When oxygen gas is blown in, it produces CO gas of a double quantity by reaction with C in the molten steel bath according to the known reaction formula $$2C+O_2=2CO$$

that is to say, the stirring force of the blow-in gas is doubled. It follows that the stirring force can be controlled to a quintuplicate level by the use of a tuyere which is capable to controlling the flow rate to a value 2.5 times as great as the minimum flow rate as mentioned hereinbefore. This implies that the dual type annular tuyere has extremely favorable characteristics for the top and bottom blown converters.

Figure 9:
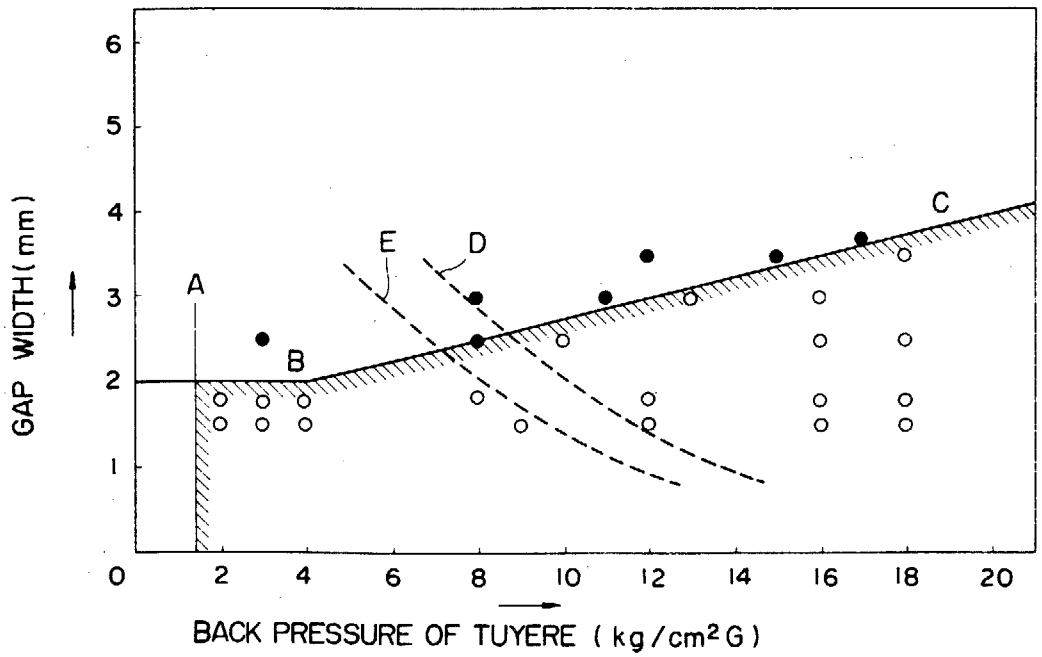
FIG. 9 is a graph plotting occurrences and nonoccurrences tuyere blockade in relation to the gap width and tuyere back pressure.
Figure 10:
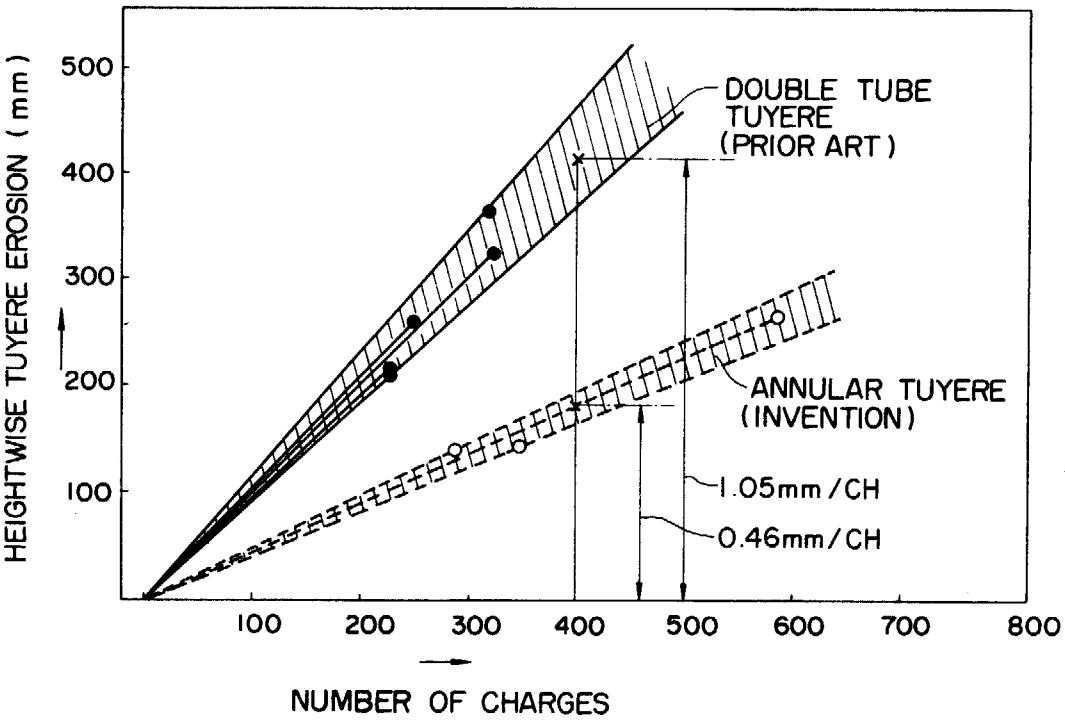
FIG. 10 is a graph showing the heightwise erosion of a single type annular tuyere in relation to the number of refining charges.
Figure 11:
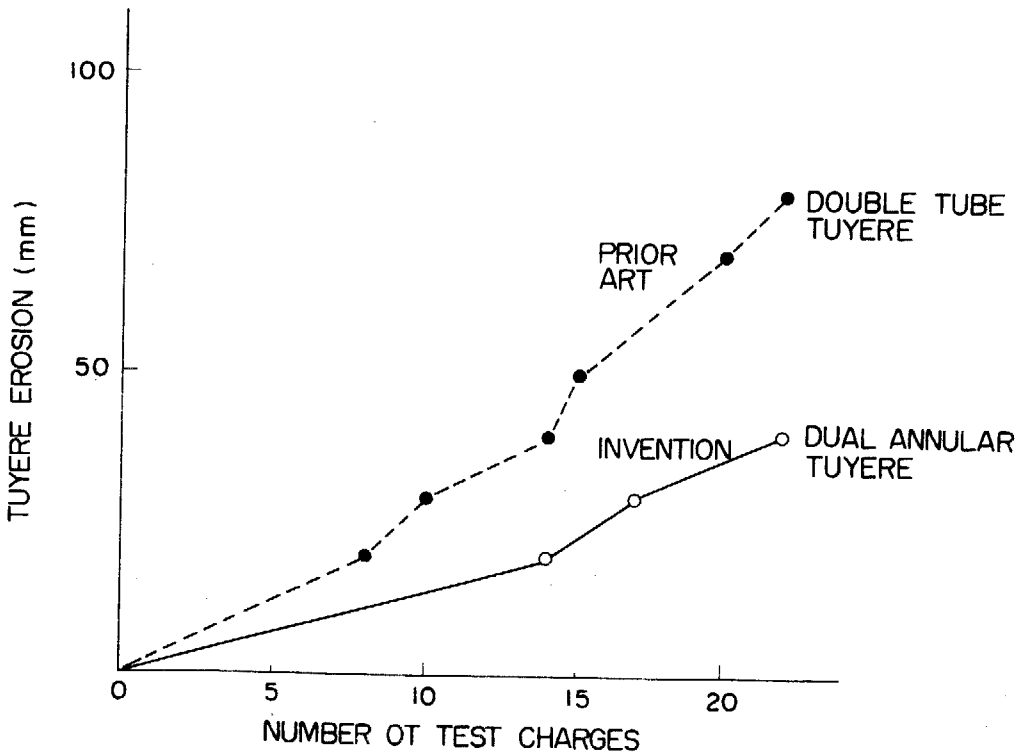
FIG. 11 is a graph showing the heightwise erosion of a dual type annular tuyere in relation to the number of refining charges.
Figure 12:
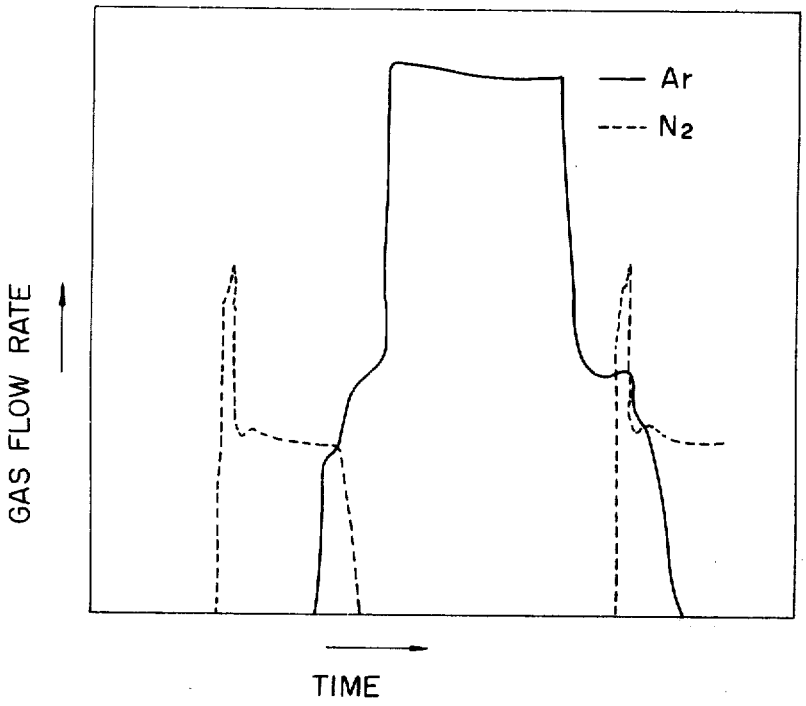
FIG. 12 is a chart of a refining time schedule in one example.

The graph of FIG. 9 shows the results of experiments studying the liability to tuyere blocking by varying the gap width and back pressure of tuyeres in a refining process using a 240-ton converter with a pair of single type annular tuyeres of FIG. 5 embedded at the bottom thereof. In this figure, a solid black circle indicates the occurrence of tuyrere blockade while a white or blank circle denotes nonoccurrence. The blank circle also indicates that a stable blowing operation was possible without the trouble of tuyere blockade over several hundreds of charges. Straight lines B and C are guide lines which indicate the boundaries of the regions of the blank and solid black circles. In other words, the safe region is on the higher back pressure side or narrower gap side of these lines. Further, the straight line A corresponds to the static pressure of molten steel so that in some cases the back pressure of the tuyere can be lowered to a level close to that line. In such a case, however, the back pressure should be increased as promptly as possible in order to secure a desired gas flow rate. In the same figure, curve D indicates the condition where the calculated value of linear gas velocity at the spout end of the tuyere reaches the sonic level in a blowing operation using an Ar gas blowing tuyere over a length of about 1200 mm, while curve E denotes a level which is 2 kg/cm$^2$ lower than the curve D. The number of charges and heightwise erosion of the tuyere in blowing operations at a pressure higher than curve D or at least higher than curve E were as shown in FIG. 10. In this regard, it has been found that the amount of erosion of the double-tube tuyere, which is about 1.05 mm/CH, can be diminished to about ½, namely, to about 0.46 mm/CH by the use of the tuyere shown in FIG. 5. The amount of erosion of the refractory material in blowing operations by the concentric double-tube tuyere and the dual type annular tuyere are shown in FIG. 11 for the purpose of comparison. It will be seen therefrom that the erosion of the refractory material is also reduced approximately to ½ when the annular tuyere is used in place of the conventional double-tube tuyere. FIG. 12 is a chart showing a refining time schedule for each charge in an inert gas blowing experiment using a single type annular tuyere. In the experiment, $N_2$ gas was blown into the converter before charging molten pig iron, and the blowing gas was switched to Ar as soon as the charging is finished to start refining, in order to prevent $N_2$ from dissolving into the molten steel during the refining process. The blowing gas was switched again to $N_2$ at a time point when the refining was terminated.

Figure 13:
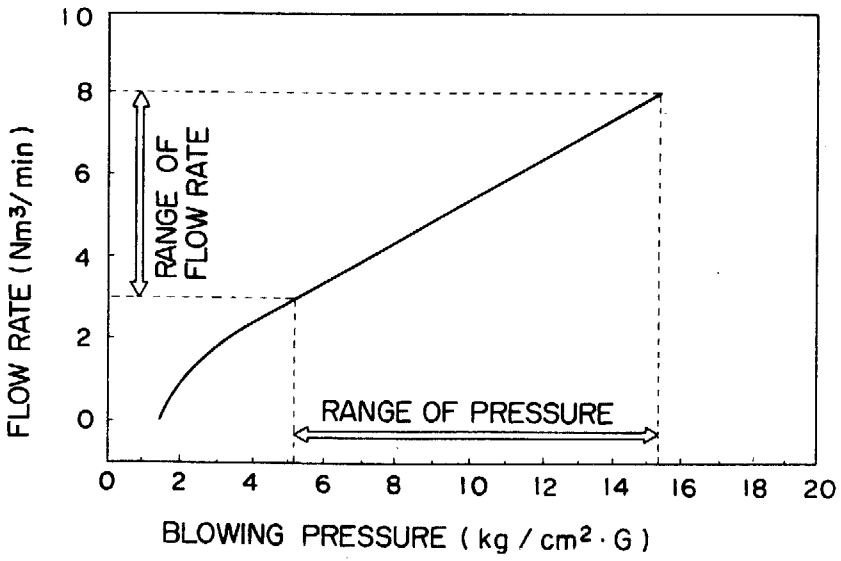
FIG. 13 is a graph showing the relation between the pressure range and the flow rate range of the single type annular tuyere of the invention.

FIG. 13 graphically illustrates an example of flow rate control using the single type annular tuyere. As shown, it is possible to stably control the flow rate of the blowing gas at 3.0–8.0 Nm$^3$/min by controlling the blowing gas pressure in a broad range of about 5.2–15.4 kg/cm$^2$G.

As described hereinbefore, the annular tuyere according to the present invention is effective for broadening the flow rate control range and prolonging the life of the refractory walls in the vicinity of the tuyere. However, a further study including pilot tests on annular tuyeres of various dimensions revealed that the back attacks due to the back flows of the blown gas could be increased in some cases depending upon the tuyere design, giving rise to a necessity for establishing a dimensional definition of a preferred tuyere design.

Namely, the annular tuyere according to the present invention is preferred to be constructed to satisfy the following conditions.

$$0.02 \leqq t/D \leqq 0.08$$

$$0.1 \leqq d/D \leqq 0.4$$

$$t/D \leqq -0.11 d/D + 0.11$$

where t is the width of the gap between the core body and outer tube of the tuyere, d is the diameter of the core body and D is the outside diameter of the outer tube.

In designing an annular tuyere of the above-mentioned construction, it is necessary to take into account the pressure of the injecting field as well as dimensional factors of the tuyere and blowing pressures such that a sonic velocity is attained after isoentropic change. That is to say, in general the velocity of the blowing gas which runs up through the tuyere suddenly increases and reaches the sonic velocity at the spout end of the tuyere. At this time, if the frictional pressure loss is large, the blowing gas forms an overexpanded flow and loses stability due to generation of exfoliated flows and waves of condensation and rarefactions. On the other hand, it is known that the coefficient of flow rate through a tuyere (in other words, the coefficient of the stirring flow) varies depending upon the opening angle of the tuyere hole, which for example is about 0.75 in the case of a straight tuyere as shown in FIG. 5. It is therefore considered that the lower limit of the stable blowing velocity of the above-mentioned tuyere is about 75% of the sonic velocity.

On the other hand, for increasing the blowing gas flow rate of the annular tuyere, it is desirable to enlarge the outside diameter D of the tuyere and the gap width t. Especially, the frictional loss within the tuyere is reduced by enlargement of the gap width t so that the pressure of the gas blowing at the sonic level is considered to be dropped in view of the flow characteristics.

Figure 14:
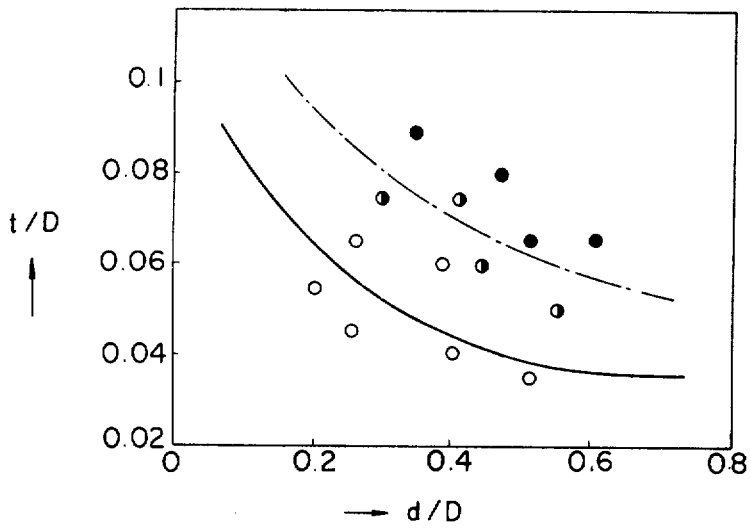
FIGS. 14 and 15 are graphs showing relations of the gap width t between a core body and an outer tube, the diameter d of the core body, the outside diameter D of the outer tube, and the blowing conditions.

Therefore, in a case where the gas is blown at a given flow rate, there is a close correlation between the outer tuyere diameter D and the gap width t and between the outer tuyere diameter D and the core diameter d. In this connection, FIG. 14 shows the relationship between the dimensional factors of the tuyere and the melting loss of the refractory material. In FIG. 14, the chain line is a subsonic line (75% of sonic velocity) in an operation blowing a gas through one tuyere hole at a rate of 0.08 Nm$^3$/min per ton of molten steel, while the solid line is a subsonic line (do.) in an operation blowing a gas through one tuyere hole at a rate of 0.06 Nm/$^3$/min per ton of molten steel. The extents of erosion of the refractory material around the tuyere is indicated by a blank circle (for a loss lower than 0.4 mm/charge), a half-black circle (for a loss of 0.4–0.6 mm/charge) and a solid black circle (for a loss greater than 0.6 mm/charge). It is known from the data of FIG. 14 that, in order to secure blowing in the subsonic range, the tuyere should have a smaller ratio of t/D when the ratio d/D is on the higher side or vice versa.

Figure 1:
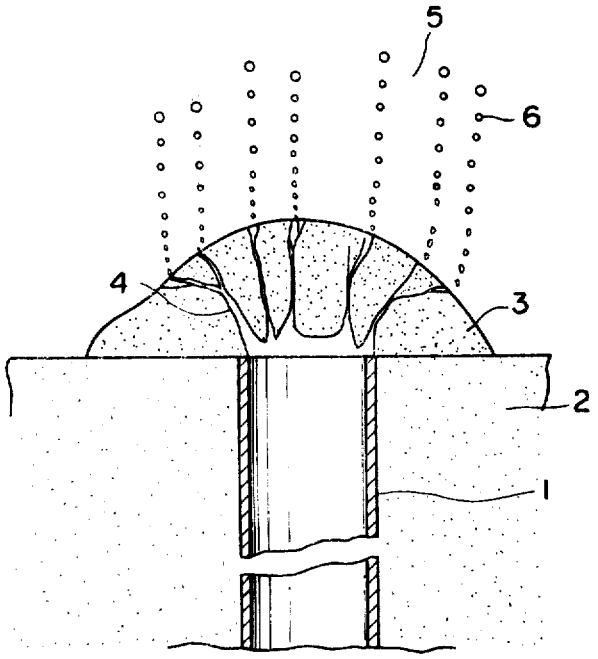
FIG. 1 is a sectional view of a conventional tuyere.
Figure 15:
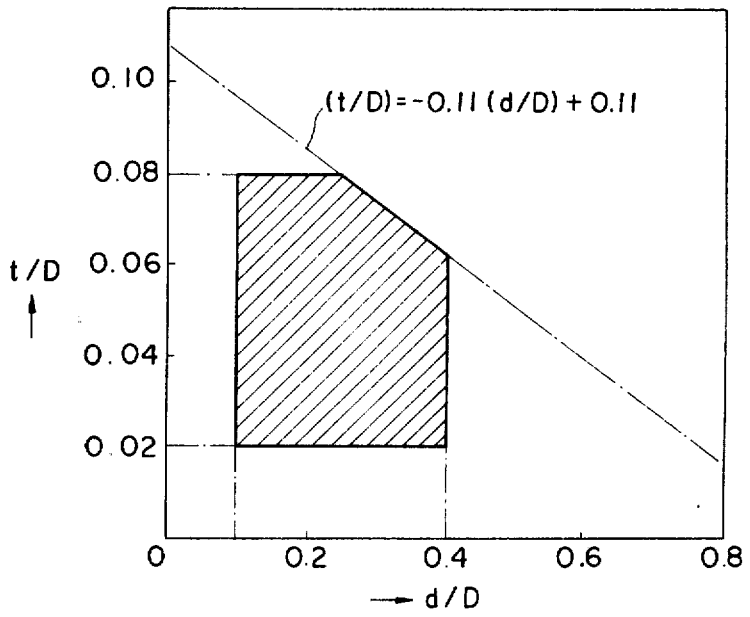

FIG. 15 shows the range of smaller erosion, which is determined on the basis of the data given in FIG. 14. As shown in FIG. 15, the ratio of d/D is limited to 0.4 since otherwise a vacuum is developed in the gas flows at the spout end of the tuyere and the molten steel tends to flow into the tuyere under the influence of even a slight outer disturbance, coupled with increases in the amount of erosion and the trend toward the back attack phenomenon. On the other hand, d/D ratios smaller than 0.1 are also excluded as they make no substantial difference from the known single tube tuyere of FIG. 1 although the adverse effect of the vacuum portions is reduced. Similarly, the tuyere loses the characteristics inherent to the annular tuyere of the invention if the ratio t/D becomes greater than 0.08, showing a performance similar to the double-tube type tuyere. Further, a t/D ratio smaller than 0.02 reflects an extremely small gap width of the tuyere which is unacceptable in consideration of difficulties in the machining stage. Accordingly, t/D ratios greater than 0.08 as well as t/D ratios smaller than 0.02 are excluded from the range of the present invention. As mentioned hereinbefore, it is desirable to determine the values of t/D and d/D in an inversely proportional relation and to exclude the range of $t/D > -0.11\, d/D + 0.11$ where the amount of erosion increases. Thus, the hatched area of FIG. 15 defines the preferred range of the present invention which permits control of the blowing gas flow rate over a broad range and at the same time suppressing the melting loss of the refractory material in the vicinity of the blowing tuyere to a minimum. Although the foregoing description has been directed to the dimensional conditions of the tuyere of FIG. 5, it is to be understood that the same applies to the dual type annular tuyere of FIG. 6 except the dimensions of the outermost tube.

As clear from the foregoing description, the present invention makes it possible to carry out a uniform and safe gas blowing operation continuously when gas stirring is required for molten metals in various containers by providing an annular blowing tuyere or tuyeres in the bottom or side walls of the containers. Moreover, the tuyere of the invention can reduce the attritional erosion by back attacks of the refractory material to a considerable degree, so that, if applied to converters, it contributes greatly to the elimination of obstacles which lie in the way to the industrialization of top and bottom blown refining processes.

What is claimed as new and desired to be secured by Letters Patent of the United States is:

1. A tuyere having a longitudinal axis, said tuyere for blowing a gas therethrough to be embedded in a bottom or side wall of a molten metal bath container, said tuyere comprising:

a cylindrical core body which further comprises a solid refractory material having a first outer diameter and located at the center of said tuyere coaxially with respect to said longitudinal axis;

a first tube having a second outer diameter and fixed coaxially around and immediately adjacent said core body and forming a first continuous annular gap having a first width forming a first annular blowing passage;

means for reducing erosion of said wall of said molten metal bath container adjacent said tuyere; and means for stabilizing a flow rate of said gas through said tuyere over a wide range of said flow rate.

2. A tuyere as claimed in claim 1 wherein said core body of said refractory material further exclusively comprises a substantially homogeneous core body.

3. A tuyere as claimed in claim 1 further comprising a second tube fixed coaxially around and radially outwardly from said first tube and forming a second annular gap therebetween, said second gap having a second width forming a second annular blowing passage.

4. A tuyere as claimed in claim 1 wherein said means for reducing erosion further comprises said core body and said first tube being arranged such that $0.02 \leqq t/d \leqq 0.08$, wherein t represents said first width of said first annular gap and d represents said first outer diameter of said core body.

5. A tuyere as claimed in claim 1 wherein said means for stabilizing said flow rate further comprises said core body and said first tube arranged such that a ratio of said first outer diameter of said core body to said second diameter of said first tube lies within a range between 0.1 and 0.4.

6. A tuyere as claimed in claim 4 wherein said means for stabilizing said flow rate further comprises said core body and said first tube arranged such that a ratio of said first outer diameter of said core body to said second diameter of said first tube lies within a range between 0.1 and 0.4.

7. A tuyere as claimed in claim 6 wherein said means for reducing erosion and said means for stabilizing said flow rate each further comprises said first tube disposed about said core body such that the following structural relationship is satisfied, $$t/D = -0.11d/D + 0.11$$

where t is said first width of said gap, d is said first outer diameter of said core body, and D is said second outer diameter of said first tube.

8. A tuyere as claimed in claims 1, 2, 3, 4, 5, 6 or 7, wherein said first width of said annular gap further comprises a gap smaller than 3 mm.

* * * * *